US009243768B2

(12) United States Patent
Minami et al.

(10) Patent No.: US 9,243,768 B2
(45) Date of Patent: Jan. 26, 2016

(54) LIGHT SOURCE FOR HEADLIGHT AND HEADLIGHT

(75) Inventors: Fumihiro Minami, Tokyo (JP); Javier Escobar, Tokyo (JP); Takashi Ohsawa, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 14/365,889

(22) PCT Filed: Mar. 6, 2012

(86) PCT No.: PCT/JP2012/001527

§ 371 (c)(1),
(2), (4) Date: Jun. 16, 2014

(87) PCT Pub. No.: WO2013/132530

PCT Pub. Date: Sep. 12, 2013

(65) Prior Publication Data

US 2014/0340923 A1 Nov. 20, 2014

(51) Int. Cl.

| | |
|---|---|
| ***F21S 8/10*** | (2006.01) |
| ***F21K 99/00*** | (2010.01) |
| *F21W 101/10* | (2006.01) |
| *F21Y 101/02* | (2006.01) |

(52) U.S. Cl.

CPC . *F21S 48/12* (2013.01); *F21K 9/50* (2013.01); *F21S 48/1145* (2013.01); *F21S 48/1159* (2013.01); *F21S 48/1225* (2013.01); *F21S 48/13* (2013.01); *F21S 48/1323* (2013.01); *F21S 48/14* (2013.01); *F21S 48/32* (2013.01); *F21S 48/328* (2013.01); *F21W 2101/10* (2013.01); *F21Y 2101/02* (2013.01)

(58) Field of Classification Search

None

See application file for complete search history.

(56) References Cited

U.S. PATENT DOCUMENTS

| | | | | |
|---|---|---|---|---|
| 7,997,778 | B2 | 8/2011 | Okada | |
| 2004/0196663 | A1 | 10/2004 | Ishida et al. | |
| 2004/0213014 | A1 | 10/2004 | Koike | |
| 2004/0223338 | A1 | 11/2004 | Koike et al. | |
| 2005/0207162 | A1 * | 9/2005 | Komatsu | 362/296 |
| 2013/0314937 | A1 * | 11/2013 | Takahashi et al. | 362/538 |

FOREIGN PATENT DOCUMENTS

| | | | |
|---|---|---|---|
| DE | 102004016416 | A1 | 11/2004 |
| DE | 102009025974 | A1 | 12/2010 |
| JP | 2004-342574 | A | 12/2004 |
| JP | 2011-198658 | A | 10/2011 |
| JP | 2011-222367 | A | 11/2011 |
| WO | WO 2011/111476 | A1 | 9/2011 |

* cited by examiner

*Primary Examiner* — Ashok Patel

(74) *Attorney, Agent, or Firm* — Birch, Stewart, Kolasch & Birch, LLP

(57) ABSTRACT

In an LED2 having a directionality in an emission direction of emitted light, light emitted from a light emitting surface of the LED 2 is refracted by a semi-cylindrical concave lens 3 to be enlarged in the circumference direction of an optical axis of a headlight 1; thus, even when the LED2 is applied to a headlight that is constituted by optical members that are similar to optical members that are compatible with conventional light sources having no directionality, such as an incandescent lamp, a discharge lamp and the like, it can be used as a light source for headlight that is capable of illuminating the right and left directions ahead of a vehicle with a sufficient brightness.

13 Claims, 15 Drawing Sheets

LIGHT SOURCE FOR HEADLIGHT AND HEADLIGHT

TECHNICAL FIELD

The present invention relates to a light source for headlight using an LED (semiconductor light source, "Light Emitting Diode") that emits light from its substantially planar light-emitting surface, and to a headlight using the light source.

BACKGROUND ART

Recently, as a light source for in-vehicle headlights (driving lights, passing lights, and so on), an LED has become popular in place of a conventional tungsten-filament incandescent lamp and a discharge lamp by arc discharge. The LED can ensure required brightness with long life and less power, and further can emit light with stable brightness under a simple control that supplies a constant current thereto to be thus preferred as a light source for a vehicular lighting fixture.

Meanwhile, since the LED emits the light from a flat surface of a semiconductor chip, it has a directionality such that emission in a normal direction from the light emitting surface is intensive, but that emission in a direction parallel to the light emitting surface is very little; as a light source for the headlight that is constituted by optical members for a conventional light source that corresponds to a non-directional linear light source such as the incandescent lamp or discharge lamp, even if the LED having a light emitting part that is elongated in its optical axis direction like the conventional light source is used, the amount of light illuminating the right and left directions ahead of an vehicle is insufficient, and hence when the LED is used as the light source, the optical members for the conventional light source cannot be diverted thereto. Accordingly, for the headlight using a current LED as the light source, a newly-designed LED-dedicated optical member is generally used; however, when the above LED having the light emitting part elongated in its optical axis direction is used, and further the directionality thereof can be adapted like the conventional light source, the optical members for the conventional light source can be diverted thereto together with techniques cultivated so far, and thus compatibility with the conventional light source can be established, so that a more preferred light source for headlight can be achieved. In the following, conventional examples of the lighting fixture using the LED as the light source will be shown.

A vehicular lighting fixture according to Patent Document 1 has a configuration in which the number of LEDs to be lighted is increased in order to achieve sufficient brightness as a vehicular headlamp, in such a manner that the LEDs are arranged on the upward, downward, leftward and rightward faces of a rectangular-column base so as to arrange a large number of LEDs in a narrow space. In Patent Document 1, since the large number of LEDs that are arranged to solve the issue of the insufficiency of the amount of light are complemented in light-emission directionality with each other, there exists no problem regarding the light-emission directionality of the LED.

Accordingly, there is no description about measures to solve a problem where a light emitting element having a light-emission directionality in one direction is used alone.

Meanwhile, a vehicular headlight according to Patent Document 2 has the following configuration: while an LED with a light emitting surface elongated in a right-left direction of a vehicle is used with projector-type optical members, a concave lens is arranged between a reflection mirror and the LED in order to achieve a light distribution that is narrow in the right-left direction. In Patent Document 2, since an optical member that acts as the concave lens (typical concave lens) is provided over the front-back and right-left directions of an LED light emitting surface thereof, there exists no problem regarding the emission directionality of a rectangular-shaped LED that is elongated in an optical axis direction of the headlight (the same direction as the front-back direction of the vehicle).

Accordingly, there is no description about measures to solve a problem where a light emitting element having a light emitting surface that is almost planar and elongated in the optical axis direction is used.

Meanwhile, a vehicular headlight according to Patent Document 3 has a configuration that uses an LED with a light emitting surface elongated in the right-left direction of a vehicle, and a reflection mirror (optical member) comprising a parabolic free curved surface, in order to achieve a light distribution pattern for a low beam (passing light). In Patent Document 3, "energy distributions of a semiconductor-type light source" are disclosed in FIG. 8 and FIG. 9, and thus it is conceived that the directionality of the LED is taken into consideration. However, since the headlight is configured by a combination of the rectangular LEDs each elongated in the right-left direction of the vehicle, there exists no problem regarding the light-emission directionality of the rectangular LED elongated in the optical axis direction.

Accordingly, there is no description about measures to solve a problem where a light emitting element having a light emitting surface that is almost planar and elongated in the optical axis direction is used.

Meanwhile, an LED valve according to Patent Document 4 is configured in consideration of compatibility between a filament-type light source and an LED light source, and has a configuration in which the LED light source is mounted in a head lamp for use of the filament-type light source. On this occasion, in order to emit light equal to that from the filament-type light source to a concave reflection mirror of the head lamp, the light emitting surface of the LED is aligned in a vertical direction thereto and a reflection member is provided just in front of the LED, so that the light emitted forward from the LED is reflected by the reflection member and led to the concave reflection mirror. In Patent Document 4, the LED of which the light emitting surface is aligned in the vertical direction is used as the light source, and the light-emission directionality of the LED is adjusted by the reflection member provided just in front of the LED, but the directionality of the light emitting element that is elongated in the optical axis direction is not adjusted.

Accordingly, there is no description about measures to solve a problem where a light emitting element that is elongated in the optical axis direction is used.

PRIOR ART DOCUMENTS

Patent Documents

Patent Document 1: Japanese Patent Application Laid-open No. 2004-342574

Patent Document 2: Japanese Patent Application Laid-open No. 2011-198658

Patent Document 3: Japanese Patent Application Laid-open No. 2011-222367

Patent Document 4: International publication No. WO2011/111476, pamphlet

SUMMARY OF THE INVENTION

Problems to be Solved by the Invention

As mentioned above, unless the directivity is provided like the conventional light source, even if the light emitting element having the rectangular light emitting surface that is elongated in the optical axis direction is used as the light source of the vehicular headlight that is constructed by optical members for the conventional light source, there is a problem such that the light amount insufficiency occurs in the right and left directions ahead of the vehicle. Nevertheless, in Patent Documents 1 to 4, there is no description about measures to deal with the light-emission directionality at the time of using the light emitting element having a rectangular-shaped light emitting surface that is elongated in the optical axis direction.

The present invention is made to solve the foregoing problems, and an object of the invention is to provide a light source for headlight and a headlight that irradiate bright light in the right and left directions ahead of the vehicle even when using the light emitting element that emits light from the substantially flat surface and the optical members for the conventional light sources, similarly to the headlight using the conventional light sources.

Means for Solving the Problems

A light source for headlight of the invention includes: alight emitting element having a light emitting surface that is substantially planar and elongated in an optical axis direction of a headlight; and a semi-cylindrical concave lens having a focal axis in substantially the same direction as the optical axis direction of the headlight, and it is configured that the semi-cylindrical concave lens is placed between an optical member and the light emitting element.

Further, a headlight of the invention includes the aforementioned light source for headlight, and an optical member that irradiates ahead of a vehicle the light emitted by the light source for headlight.

Effect of the Invention

According to the present invention, by using the light emitting element having the light emitting surface elongated in the optical axis direction of the headlight, it is possible to irradiate farther the front ahead of the vehicle brightly, and further, by using the semi-cylindrical concave lens that covers the light emitting surface of the light emitting element, the light emitted from the light emitting surface is spread radially about the optical axis of the headlight, and it is thus possible to irradiate a wider range in the right and left directions of the vehicle. Accordingly, it becomes possible to handle the light source for headlight having the substantially planar light emitting surface in the same manner as conventional linear light sources such as incandescent lamps and discharge lamps, so that the headlight can be configured easily by diverting the optical members and design techniques for the conventional light source thereto.

BRIEF DESCRIPTION OF THE DRAWINGS

FIG. 2(*a*) is a cross-sectional view thereof; FIG. 2(*b*) is a front view thereof; and FIG. 2(*c*) is a diagram representing road-surface irradiation light.

FIG. 10(*a*) is a cross-sectional view showing an internal structure of the headlight; FIG. 10(*b*) is a front view thereof; FIG. 10(*c*) is a diagram representing road-surface irradiation light; and FIG. 10(*d*) is a light distribution of the LED in a plane viewed in an arrow-direction.

FIG. 12(*a*) is a cross-sectional view showing an internal structure of the headlight; FIG. 12(*b*) is a diagram representing road-surface irradiation light; and FIG. 12(*c*) is a light distribution of the LED in a plane IV-IV viewed in an arrow-direction.

FIG. 13(*a*) is a cross-sectional view thereof; FIG. 13(*b*) is a front-view thereof; FIG. 13(*c*) is a diagram representing road-surface irradiation light; and FIG. 13(*d*) is a light distribution of the LED in a plane V-V viewed in an arrow-direction.

FIG. 17(*a*) is a front view thereof; and FIG. 17(*b*) is a side view thereof.

FIG. 18(*a*) is a front view thereof, and FIG. 18(*b*) is a side view thereof.

FIG. 20(*a*) is a cross-sectional view thereof; and FIG. 20(*b*) is a diagram representing road-surface irradiation light.

FIG. 21(*a*) is a cross-sectional view thereof; and FIG. 21(*b*) is a diagram representing road-surface irradiation light.

BEST MODE FOR CARRYING OUT THE INVENTION

Hereinafter, for illustrating the invention in more detail, embodiments for carrying out the invention will be described according to the accompanying drawings.

Embodiment 1

Figure 1:
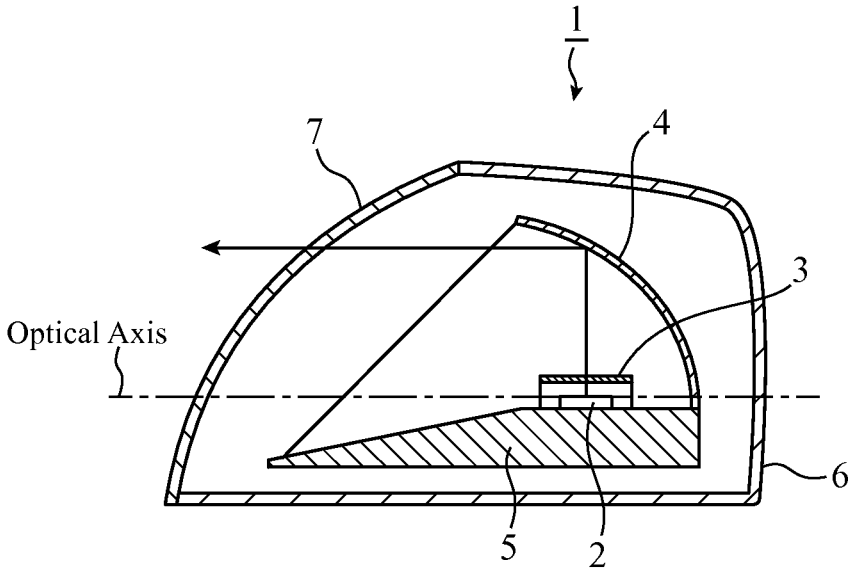
FIG. 1 is a cross-sectional view showing a configuration of a headlight according to Embodiment 1 of the present invention.
Figure 2:
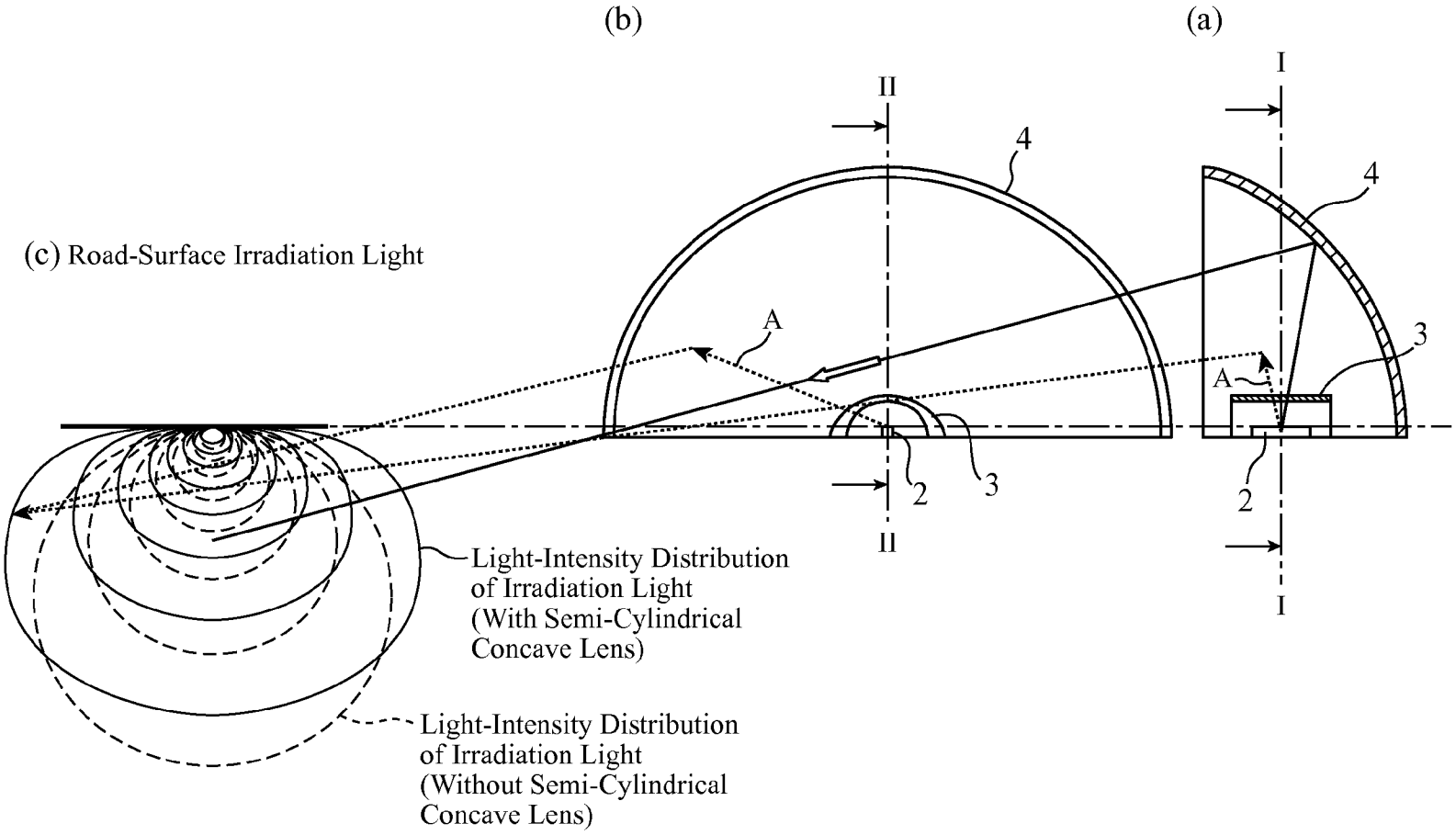
FIG. 2 shows an internal structure of the headlight according to Embodiment 1.

As shown in FIG. 1 and FIG. 2, a headlight 1 according to Embodiment 1 includes: an LED 2 having a substantially planar light emitting surface elongated in an optical axis direction of the headlight 1; a semi-cylindrical concave lens 3 having a focal axis in substantially the same direction as that optical axis; a parabolic reflection mirror 4 that irradiates light emitted by the LED 2 ahead (to the front side) of a vehicle; an auxiliary reflection mirror 5 used also as a heat sink of the LED 2; a casing 6; and a front lens 7. The optical axis direction of the headlight 1 is the same as the front-back (longitudinal) direction of the vehicle.

In a case where a conventional incandescent lamp (halogen lamp) based on red heat emission of a tungsten filament, discharge lamp (HID lamp) based on arc discharge, and the like are used as light sources, because these conventional light sources have a characteristic of emitting light in all directions, it is possible to easily configure the headlight 1 that irradiates sufficient light not only in the front direction of the vehicle, but also in the right and left directions of the vehicle. In contrast, since the LED 2 that emits the light from the flat surface of a semiconductor chip has a light-emission directionality that is different from the light-emission directionality of the conventional light sources, when the LED 2 is used as a light source of the headlight 1, it becomes necessary to take measures corresponding to that directionality.

Note that in the present description, because the tungsten filament and the light emitting portion for arc discharge have a certain length, the corresponding light source is assumed as a linear light source.

Figure 3:
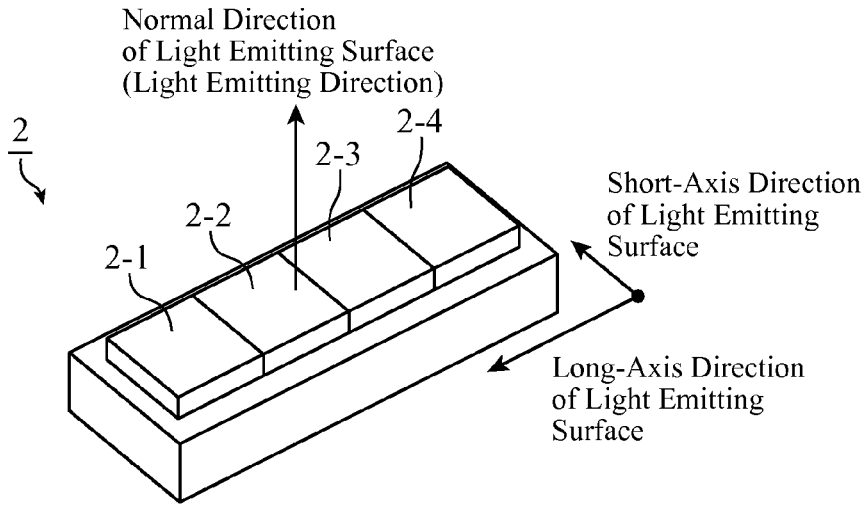
FIG. 3 is a perspective view showing a configuration of an LED in a light source for headlight according to Embodiment 1.

In FIG. 3, a configuration example of the LED 2 is shown. The LED 2 is an LED array in which a plurality of semiconductor chips 2-1 to 2-4 are linearly arranged, and a collection of the light emitting surfaces of these semiconductor chips 2-1 to 2-4 are regarded as one light emitting surface. A long-axis direction of this rectangular light emitting surface is placed in parallel to the optical axis direction of the headlight 1.

Instead, a single LED having the rectangular light emitting surface may be used as the LED 2. Further, the shape of the light emitting surface is not necessarily limited to the substantially rectangular shape as shown in FIG. 3, and may be a shape other than the rectangular shape, for example, a trapezoidal or elliptical shape as long as it is elongated in the optical axis direction of the headlight 1. Furthermore, other than the LED that directly emits intended light, an LED may be used to be adapted to emit intended light by adding a fluorescent material for changing blue light to another color one to an LED that emits the blue light.

Note that the shape of the rectangular light emitting surface of the LED 2 mostly corresponds to the shape of the linear light source formed by the tungsten filament or the arc discharge of the above conventional light source.

Figure 4:
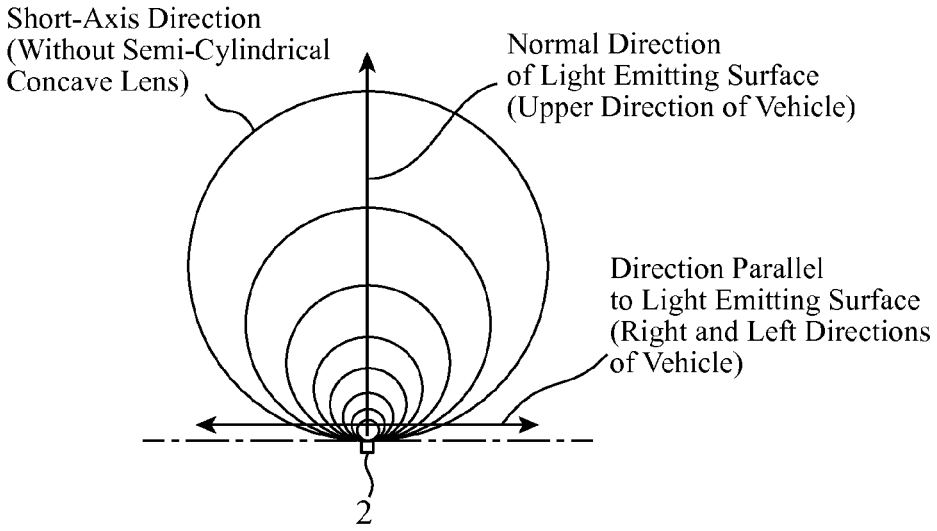
FIG. 4 is a diagram showing a light distribution of an LED in a plane I-I viewed in an arrow direction in FIG. 2(*a*) in a case without a semi-cylindrical concave lens.
Figure 5:
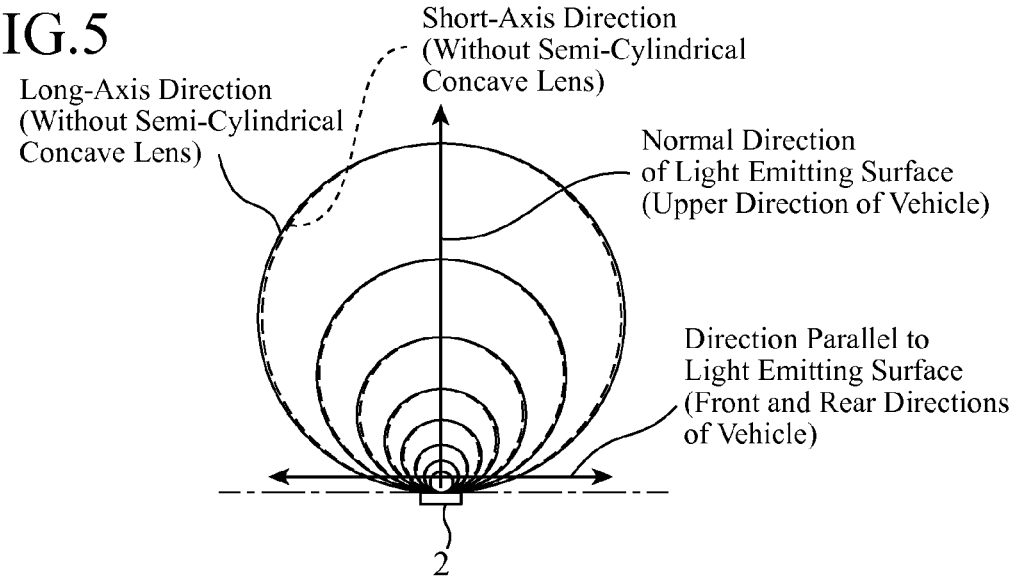
FIG. 5 is a diagram showing a light distribution of the LED in a plane II-II viewed in an arrow-direction in FIG. 2(*b*) in the case without the semi-cylindrical concave lens.

Here, in FIG. 4 and FIG. 5, light distributions of the LED 2 are shown in a case without the semi-cylindrical concave lens 3. FIG. 4 represents directionality along a plane perpendicular to the long-axis direction of the light emitting surface in a plane I-I viewed in an arrow-direction of FIG. 2(*a*), and a light-intensity distribution of the irradiation light is shown by solid lines. FIG. 5 represents directionality along a plane formed by a normal line of the light emitting surface and the long-axis line in a plane II-II viewed in an arrow-direction of FIG. 2(*b*), and a light-intensity distribution of the irradiation light is shown by solid lines.

The LED 2 has directionality such that emission in the normal direction of the light emitting surface (upper direction of the vehicle) is intensive, but that emission in the direction parallel to the light emitting surface (front, rear, right, and left directions of the vehicle) is very little. Thus, in the case of a headlight 1 without using an LED that has light emitting surfaces facing in multiple directions or a headlight 1 without a special optical member such as the semi-cylindrical concave lens 3, even if bright light is irradiated in the front direction from the immediate front of the vehicle, sufficient light cannot be irradiated in the right and left directions. In other words, brightness that illuminates the front side of the vehicle can be obtained sufficiently; however, even though the front side is bright, brightness that illuminates the right and left directions is not obtained sufficiently, so that the right and left directions are dark. Further, if sufficient brightness extending laterally is not obtained, it is unable to form a cut-off line (light-shade boundary line) required for a passing light.

Thus, in Embodiment 1, sufficient light irradiation is performed in the right and left directions of the vehicle by improving the directivity of the light emission of the LED 2 having the substantially rectangular and substantially planar light emitting surface, and in order to form sharply the cut-off line for the passing light, the light emitting surface of the LED 2 is covered with the semi-cylindrical concave lens 3 as shown in FIG. 1 and FIG. 2. Since the semi-cylindrical concave lens 3 is a member for an optical system, and it is thus essential to be transparent to visible light, it is formed of a transparent glass with a high heat-resistant temperature, or a transparent and lightweight resin.

Figure 6:
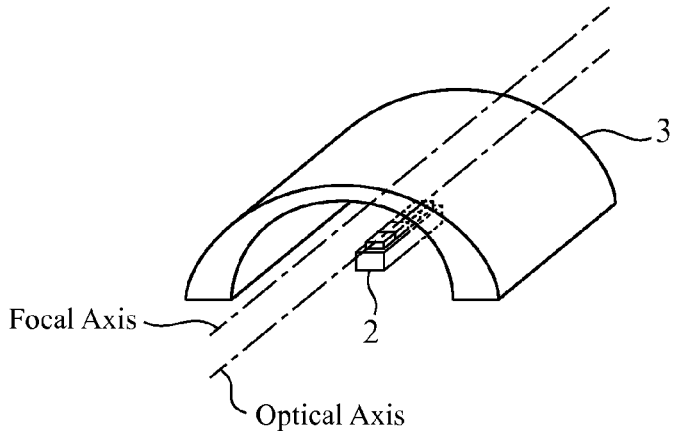
FIG. 6 is a perspective view showing a configuration of the light source for headlight according to Embodiment 1.

FIG. 6 is a perspective view of the light source for headlight including the LED 2 and the semi-cylindrical concave lens 3. In a headlight 1 configured to use simple optical members, in order to irradiate bright light in the right and left directions of the vehicle, it is favorable to have a light source that is elongated in the optical axis direction; thus, it is desirable that the light emitting surface of the LED 2 to be used be elongated in the optical axis direction. Additionally, it suffices that the semi-cylindrical concave lens 3 has an optical characteristic as a concave lens on the side perpendicular to the optical axis of the headlight 1. Thus, the semi-cylindrical concave lens 3 is used to have a focal axis in substantially the same direction as the optical axis of the headlight 1, as shown in FIG. 6.

Figure 7:
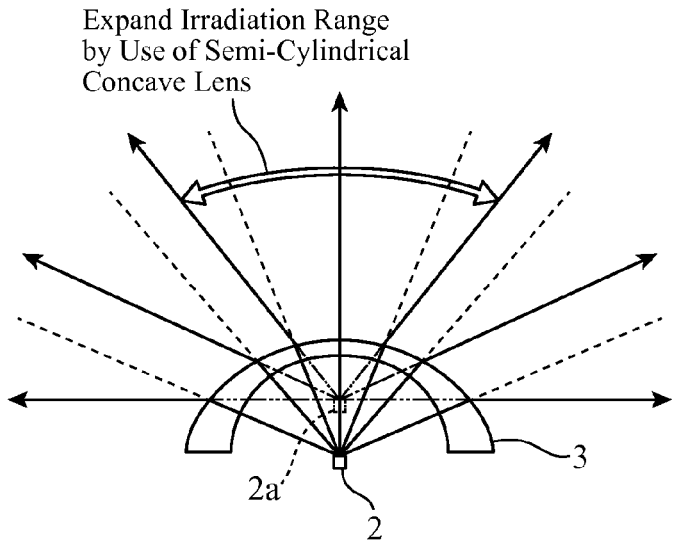
FIG. 7 is a diagram for illustrating refraction by the semi-cylindrical concave lens.
Figure 8:
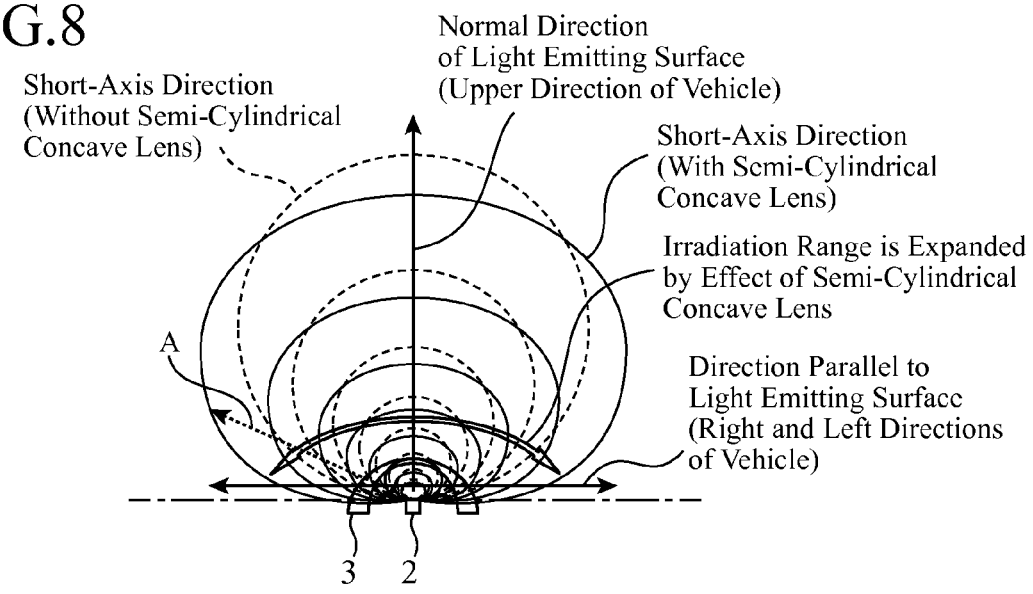
FIG. 8 is a diagram showing a light distribution of the LED in the plane I-I viewed in the arrow-direction in FIG. 2(*a*) in a case with a semi-cylindrical concave lens.
Figure 9:
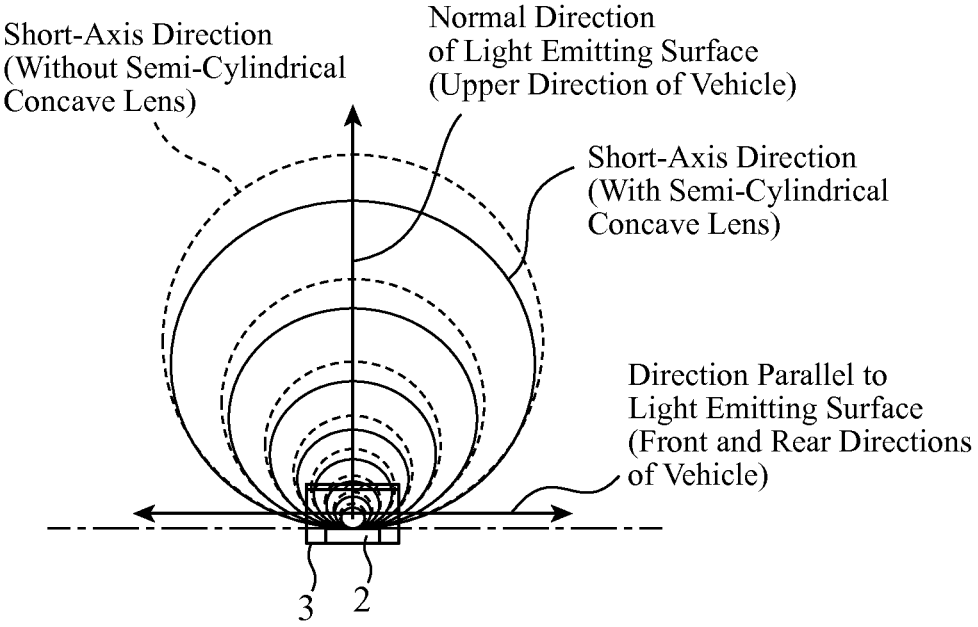
FIG. 9 is a diagram showing a light distribution of the LED in the plane II-II viewed in the arrow-direction shown in FIG. 2(*b*) in the case with the semi-cylindrical concave lens.

FIG. 7 is a diagram for illustrating refraction by the semi-cylindrical concave lens 3. Further, in FIG. 8 and FIG. 9, light distributions of the LED 2 are shown in the case with the semi-cylindrical concave lens 3. Solid lines in FIG. 8 represent the directionality along the plane perpendicular to the long-axis direction of the light emitting surface in the plane I-I viewed in the arrow-direction shown in FIG. 2(*a*). Broken lines correspond to the light distribution in the case without the semi-cylindrical concave lens 3 (FIG. 4). Solid lines in FIG. 9 represent the directionality along the plane formed by the normal line of the light emitting surface and the long-axis line thereof in the plane II-II viewed in the arrow-direction shown in FIG. 2(*b*). Broken lines correspond to the light distribution in the case without semi-cylindrical concave lens 3 (FIG. 5).

As shown by solid lines in FIG. 7, the light emitted from the light emitting surface of the LED2 is refracted by the semi-cylindrical concave lens 3 and magnified toward a circumferential direction around the focal axis of the semi-cylindrical concave lens 3 (indicated by hollow arrows in FIG. 7 and FIG. 8), it is possible to direct part of the emitted light also in a direction parallel to the light emitting surface. Namely, even if the LED 2 is placed with its light emitting surface faced in the vertical direction, it becomes possible to direct part of the emitted light in the horizontal direction. The light spread in the horizontal direction (arrow A in FIG. 2 and FIG. 8) is reflected by the reflection mirror 4 of the headlight 1 and irradiated in the right and left directions of the vehicle.

When the LED 2 is placed inside the headlight 1 with one point on its rectangular light emitting surface met at a focal point of the reflection mirror 4, the light emitted from the focal point part (shown as a solid line in FIG. 1) becomes parallel light to the optical axis of the headlight 1, to thereby irradiate farther ahead of the vehicle brightly. On the other hand, the light emitted from another part deviated from the focal point of the reflection mirror 4 is spread radially about the optical axis of the headlight 1, to thereby irradiate a wider range in the right and left directions of the vehicle.

Accordingly, even when using the LED 2 that emits the light from its substantially rectangular surface, it is possible to achieve a light distribution preferable as the headlight 1 for the vehicle.

As described above, when the LED 2 which emits the light from its light emitting surface that is substantially planar and substantially rectangular to be elongated in the optical axis direction of the headlight 1 is combined with the semi-cylindrical concave lens 3, there is provided a set of the light source for headlight.

In the headlight 1 using this light source for headlight, an intended cut-off line may be formed by shielding the irradiation light spread at an angle of 180 degrees or more radially about the optical axis of the headlight 1 with a shade (not shown) and so on.

In addition, the auxiliary reflection mirror 5 also has a function as a heat sink, and radiates the heat generated by the LED 2 and transfers the heat to the reflection mirror 4, so that the heat is radiated also from the reflection mirror 4.

Next, an example of forming a light distribution for a passing light will be described.

Figure 10:
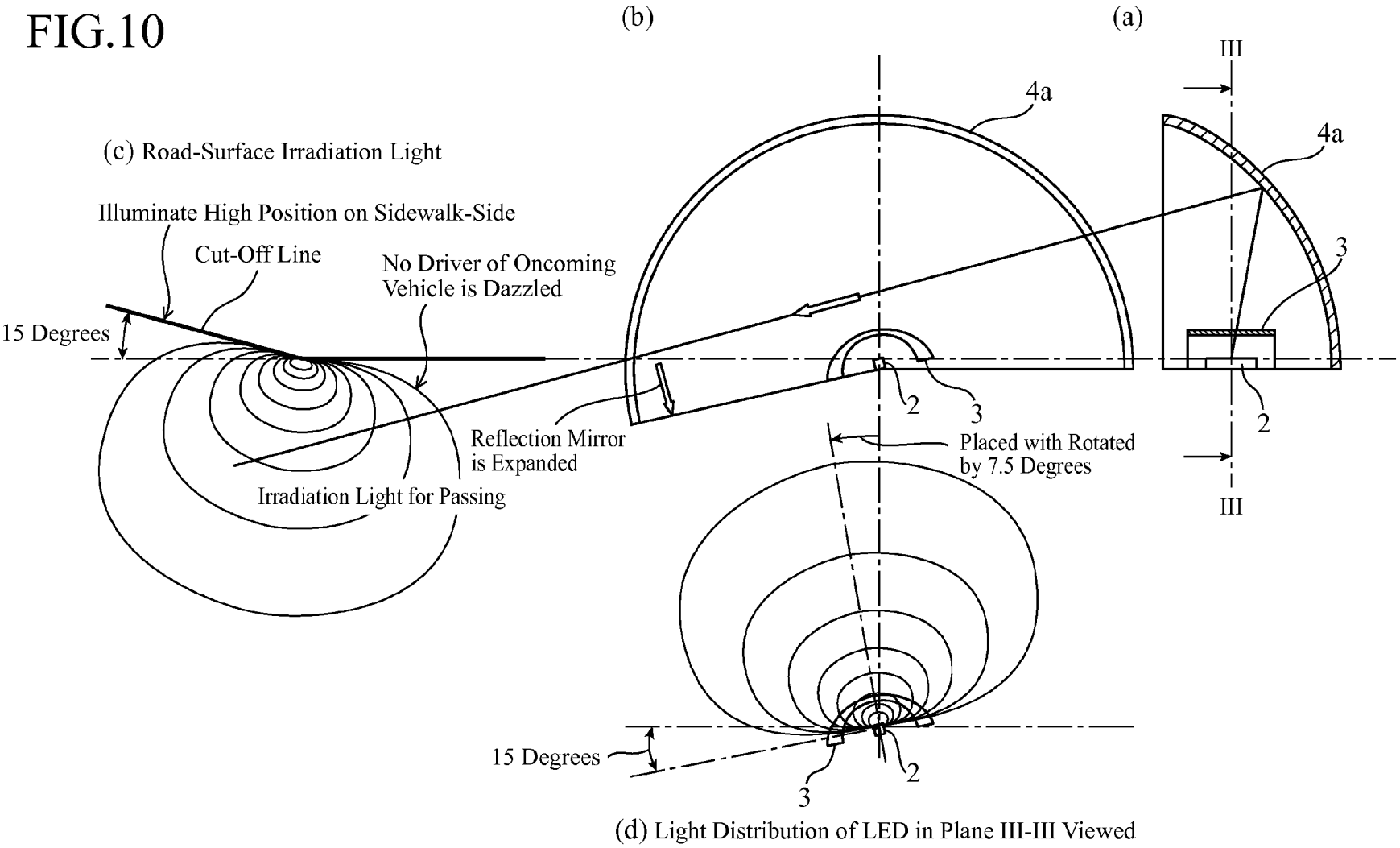
FIG. 10 shows an example of forming a light distribution for a passing light by the headlight according to Embodiment 1.

FIG. 10(*a*) is a cross-sectional view showing an internal structure of the headlight 1, FIG. 10(*b*) is a front view thereof, FIG. 10(*c*) is a diagram representing road-surface irradiation light, and FIG. 10(*d*) is a diagram representing a light distribution of the LED 2 in a plane viewed in an arrow-direction. When the semi-cylindrical concave lens 3 and the LED 2 constructed integrally are fixed to the reflection mirror 4*a* (and the auxiliary reflection mirror 5 shown in FIG. 1) in a state rotated about the optical axis of the headlight 1 as a rotation axis, the light emitting direction of the LED 2 is rotated to an appropriate angle. Note that in FIG. 10, one of the left and right sides of the reflection mirror 4*a* is expanded according to the rotation direction of the LED 2 and the semi-cylindrical concave lens 3.

For example, in a headlight 1 performing a light distribution for left-hand traffic, as shown in FIG. 10(*b*) and FIG. 10(*d*), the light emitting direction of the LED 2 is rotated clockwise by, for example, about 7.5 degrees toward the front side of the vehicle, to thereby rotate the cut-off line on the front-left side at a position elevated by about 15 degrees as shown in FIG. 10(*c*). This makes it possible to illuminate even a higher position of a left sidewalk to thereby facilitate discovery of a pedestrian, an obstacle, and so on. Further, since the irradiation to a right road can be restricted to an appropriate height, no driver of an oncoming vehicle is illuminated and dazzled, and thus no driving operation of the driver of the oncoming vehicle is interfered.

In a headlight 1 performing a light distribution for right-hand traffic, inversely to the rotation direction in FIG. 10, the light emitting direction of the LED 2 is rotated counterclockwise by, for example, about 7.5 degrees toward the front side of the vehicle, and the LED 2 and the semi-cylindrical concave lens 3 are fixed to the reflection mirror 4*a*.

Note that this configuration is an example of using the semi-cylindrical concave lens 3 that broadens by refraction the light irradiation range on the left and right sides, respectively, to an angle of 97.5 degrees with respect to the normal line of the LED 2. In this configuration, the irradiation range emitted by the LED 2 is broadened to total 195 degrees; when the light source is rotated by 7.5 degrees to the right side, the cut-off line on the front-left side is made higher by 15 degrees than the horizontal while the cut-off line on the front-right side is made horizontal.

Figure 11:
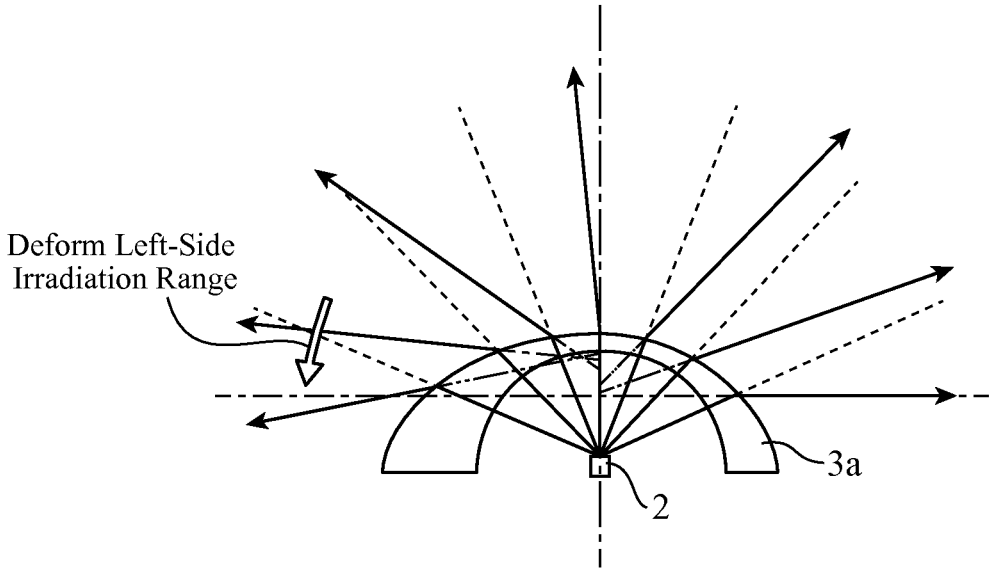
FIG. 11 is a diagram showing another example of forming a light distribution for a passing light by the headlight according to Embodiment 1.

Instead, a light distribution for a passing light may be formed by deforming the semi-cylindrical concave lens 3 as shown in FIG. 11. FIG. 11 is a diagram illustrating refraction by a deformed semi-cylindrical concave lens 3*a*. The deformed semi-cylindrical concave lens 3*a* has different values in focal length at the right and left sides to the front side of the vehicle, so that the amounts of refraction of respective light beams to be irradiated at the right and left sides are changed, to thereby rotate the substantial light emitting direction of the LED 2 to an appropriate angle. Incidentally, in FIG. 11, the concave lens is made thicker at the left side than at the right side in the direction of a paper surface, so that the light emitting direction is rotated to the left side in the direction of the paper surface.

Note that in the case of this configuration, since the light emitting direction of the LED 2 is operated by deforming the semi-cylindrical concave lens 3 into the deformed semi-cylindrical concave lens 3*a*, it is unnecessary to rotate the light emitting surface of the LED 2 unlike that of FIG. 10.

Next, an example of forming a light distribution for a driving light will be described.

Figure 12:
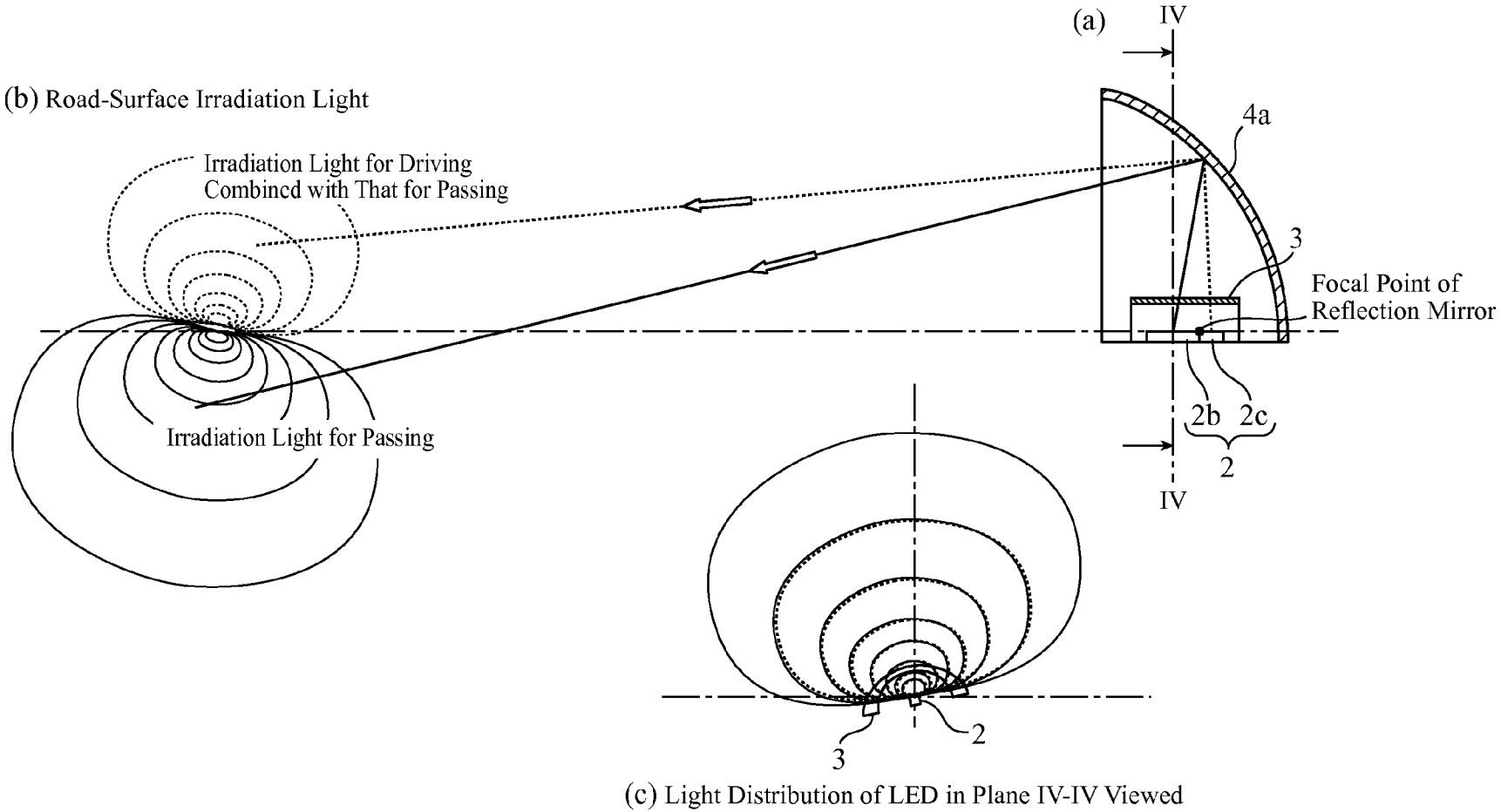
FIG. 12 shows an example of forming a light distribution for a driving light by the headlight according to Embodiment 1.

FIG. 12(*a*) is a cross-sectional view showing an internal structure of the headlight 1, FIG. 12(*b*) is a diagram representing road-surface irradiation light, and FIG. 12(*c*) is a diagram representing a light distribution of the LED 2 in a plane IV-IV viewed in an arrow-direction. An LED 2*b* by any number of the plurality of semiconductor chips 2-1 to 2-4 as shown in FIG. 3 is placed at the front (reflection mirror opening) side of the focal point of the reflection mirror 4*a*, and an LED 2*c* of the remainder is placed at the rear (reflection mirror) side of the focal point of the reflection mirror 4*a*. As shown in FIG. 12(*b*), when the LED 2*b* at the front side of the focal point of the reflection mirror 4*a* is lighted, the emitted light is reflected at the reflection mirror 4*a* to thereby irradiate the lower side of the cut-off line, so that a light distribution for a passing light can be formed. On the other hand, when both of the LED 2*c* at the rear side of the focal point of the reflection mirror 4*a* and the LED 2*b* at the front side thereof are lighted simultaneously, the light emitted by the LED 2*c* can be reflected at the reflection mirror 4*a* to thereby irradiate the upper side of the cut-off line, so that a light distribution for a driving light can be formed by both of the LEDs 2*b* and 2*c*.

Note that when white light is refracted by use of the semi-cylindrical concave lens 3 comprising one lens, the white light passing therethrough is diffracted due to chromatic aberration, so that a monochromatic color (spectrum) that constitutes the white light emerges separately at the fringe of the irradiation range, that is, in the vicinity of the dark side in the bright and dark boundary part. This is due to an effect like a prism that separates the white light into rainbow colors.

Figure 13:
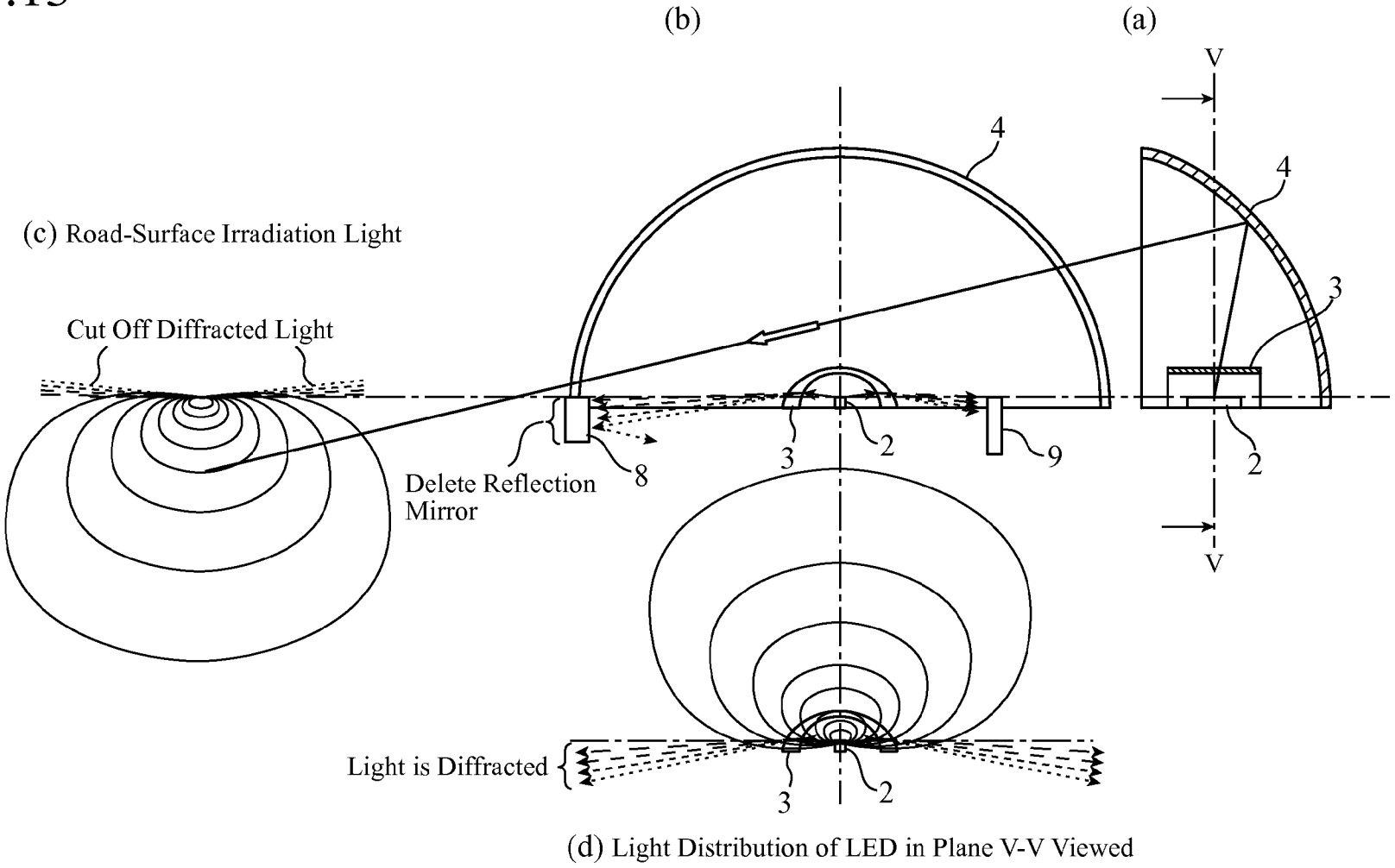
FIG. 13 shows an internal structure of a headlight according to Embodiment 1.

FIG. 13(*a*) is a cross-sectional view showing an internal structure of the headlight 1, FIG. 13(*b*) is a front view thereof, FIG. 13(*c*) is a diagram representing road-surface irradiation light, and FIG. 13(*d*) is a diagram representing a light distribution of the LED 2 in a plane V-V viewed in an arrow-direction. From the aforementioned reason, in the headlight 1, several monochromatic light beams (shown in FIG. 13 by plural broken lines) that constitute the white light emitted by the LED 2 are to be visually recognized separately in the vicinity of the dark side in the cut-off line ahead of the vehicle to be illuminated. Since such separated irradiation light impairs the driver's visibility, it is preferable that the headlight 1 be provided with a mechanism that shields (shades) the corresponding monochromatic light or reflects the beam in a harmless direction so as not to be irradiated to the front side.

There are the following examples of achieving the mechanism that causes the monochromatically separated light not to be irradiated to the front side of the vehicle:

- Delete the reflection mirror 4 on the path along which the monochromatically separated light is irradiated;
- Replace the reflection mirror 4 on the path along which the monochromatically separated light is irradiated with a monochromatic-light reflection mirror 8 having a reflection direction that is different from that of the reflection mirror 4; and
- Provide a monochromatic-light shading member 9 on the path along which the monochromatically separated light is irradiated.

From the above, according to Embodiment 1, the light source for headlight includes: the LED 2 having the light emitting surface that is substantially planar and elongated in the optical axis direction of the headlight 1; and the semi-cylindrical concave lens 3 having the focal axis in substantially the same direction as the optical axis of the headlight 1, and it is configured that the semi-cylindrical concave lens 3 is placed between the reflection mirror 4 that is the optical member of the headlight 1 and the LED 2. For this reason, it is possible to irradiate extensively the right and left directions while illuminating farther the front ahead of the vehicle brightly. Even while using the LED 2 whose light emitting surface is substantially planar, it becomes possible to irradiate sufficient light in the right and left directions of the vehicle, thereby forming a clear cut-off line in the passing light. Accordingly, it is possible to configure a safe and preferred headlight 1. Further, it is possible to handle the light source for headlight using the LED 2 whose light emitting surface is substantially planar in the same manner as the conventional linear light sources such as incandescent lamps and discharge lamps; thus, the headlight 1 can be configured easily by diverting thereto the optical members and design techniques for the conventional light sources.

Further, according to Embodiment 1, the light source for headlight is configured to include the auxiliary reflection mirror 5 that transfers heat generated by the LED 2 to a structure such as the reflection mirror 4. For this reason, since the auxiliary reflection mirror 5 serving also as a heat sink dissipates the heat generated by the LED 2, an excessively high temperature of the LED 2 can be avoided. Accordingly, degradation of the LED 2 can be prevented, and its life-span is not shortened, so that a highly reliable light source can be achieved.

Further, according to Embodiment 1, the LED 2 is configured to include the plurality of semiconductor chips 2-1 to 2-4 that can be lighted arbitrarily. For this reason, it is possible to achieve a light source applicable to the headlight 1 corresponding to plural functions.

For example, when the LED 2 is configured with the LED 2*b* placed at the front side of the focal point of the reflection mirror 4 and the LED 2*c* placed at the rear side of the focal point of the reflection mirror 4, it is possible to form a light distribution for a passing light when the LED 2*b* is lit to illuminate the front lower side of the vehicle, while it is possible to form a light distribution for a driving light when the LED 2*b* and LED 2*c* are lit to simultaneously illuminate the front lower and upper sides of the vehicle.

Further, according to Embodiment 1, since it is contemplated that the semi-cylindrical concave lens 3 is formed of an optically favorable glass or resin, it is possible to configure a simple and preferred headlight 1.

Further, according to Embodiment 1, it is configured that the headlight 1 includes the monochromatic-light shading member 9 that shields, among the light emitted by the light source for headlight, light going to the vicinity on the dark side in the bright and dark boundary, or the monochromatic-light reflection mirror 8 that reflects the light going to the vicinity on the dark side in the bright and dark boundary in a direction so as not to be irradiated to the front side of the headlight 1. For this reason, it is possible to irradiate only white light to the front side of the vehicle, so that a headlight 1 with high visibility can be achieved.

Embodiment 2

As shown in FIG. 7, when the semi-cylindrical concave lens 3 is used, a virtual image 2*a* (apparent light-emitting surface) of the LED 2 is formed nearer to the semi-cylindrical concave lens 3 than the actual light emitting surface of the LED 2. Thus, in Embodiment 2, the virtual image 2*a* of the LED 2 is placed at the position of the optical axis or the focal point of the headlight 1.

Figure 14:
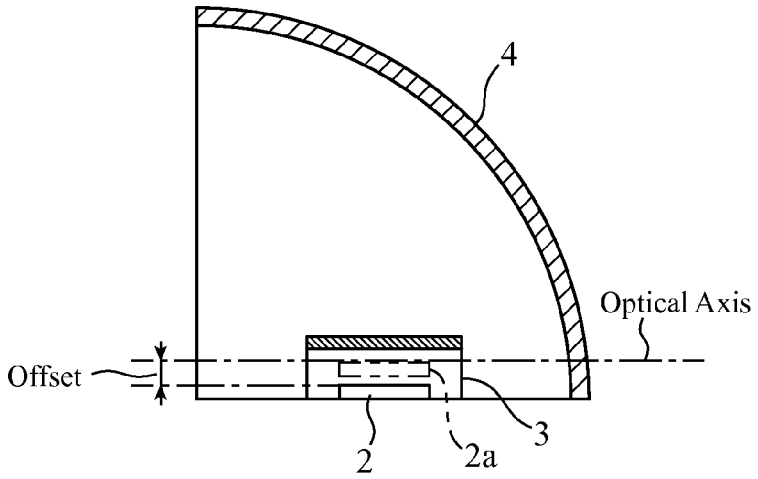
FIG. 14 is a cross-sectional view showing an internal structure of a headlight according to Embodiment 2 of the invention.

FIG. 14 is a cross-sectional view showing an internal structure of the headlight 1 according to Embodiment 2. Note that in FIG. 14, the same reference numerals are given for the same or equivalent parts as/to those of FIG. 1 to FIG. 13, and descriptions thereof will be omitted here. In order to deal with the virtual image 2*a* of the LED 2, the LED 2 is placed with an offset to the opposite side of the reflection mirror 4 with respect to the optical axis of the headlight 1.

From the above, according to Embodiment 2, the light source for headlight is configured such that the light emitting surface of the LED 2 is placed with shifted to the opposite side of the reflection mirror 4 with respect to the optical axis of the headlight 1. For this reason, it is possible to configure a headlight 1 with a favorable optical system, so that a simple and preferred headlight 1 can be achieved.

Embodiment 3

Figure 15:
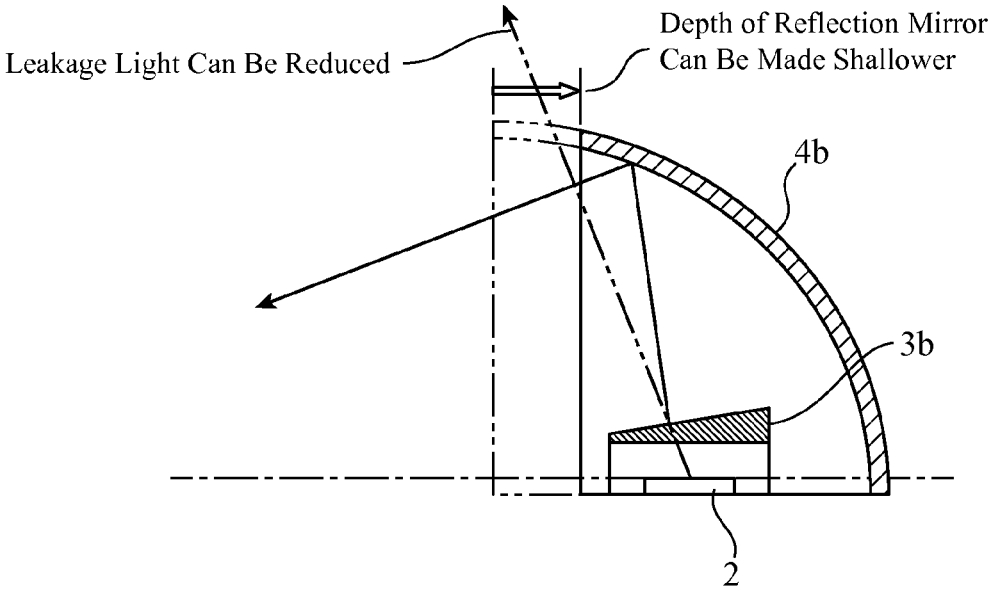
FIG. 15 is a cross-sectional view showing an internal structure of a headlight according to Embodiment 3 of the invention.

FIG. 15 is a cross-sectional view showing an internal structure of a headlight 1 according to Embodiment 3. In FIG. 15, the same reference numerals are given for the same or equivalent parts as/to those of FIG. 1 to FIG. 14, and descriptions thereof will be omitted here.

Figure 16:
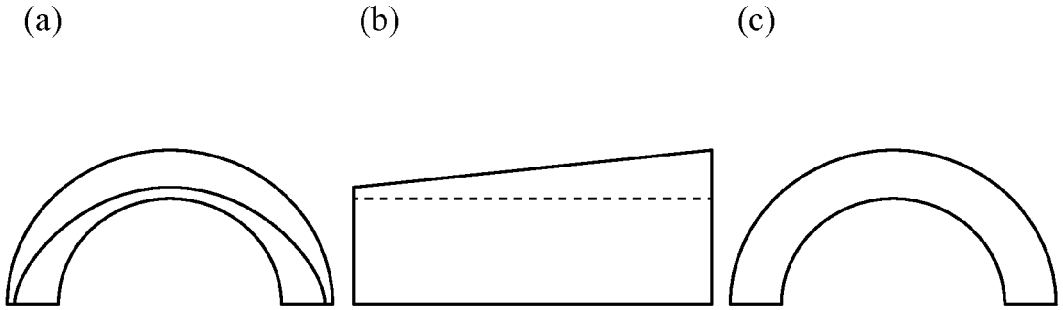
FIG. 16 shows a configuration of a semi-cylindrical concave lens with inclination: a front, a side, and a rear thereof are shown in FIG. 16(*a*), FIG. 16(*b*), and FIG. 16(*c*), respectively.

FIG. 16(*a*) shows a front of a semi-cylindrical concave lens with inclination 3*b*, FIG. 16(*b*) shows a side thereof, and FIG. 16(*c*) shows a rear thereof. The focal length of the semi-cylindrical concave lens with inclination 3*b* is made shorter at (toward) the front side of the headlight 1, and longer at (toward) the rear side of the headlight 1. In other words, the thickness of a transparent member constituting the semi-cylindrical concave lens with inclination 3*b* is made thinner at the front side of the headlight 1 and made thicker at the rear side of the headlight 1. With such a configuration, a lens effect of refracting the light emitted by the LED 2 toward the reflection mirror 4*b* is further added to a semi-cylindrical concave lens.

As compared with the light of the LED 2 in the case where a semi-cylindrical concave lens without inclination is placed (indicated by a two-dot chain line in FIG. 15), the light of the LED 2 in the case where the semi-cylindrical concave lens with inclination 3*b* is placed (indicated by a solid line in FIG. 15) is refracted to the rear side of the headlight 1 due to the difference in thickness between at the front-end side and at the rear-end side of the concave lens. On that account, it is possible to reduce light directly leaking out to the outside without being reflected by the reflection mirror. Further, the front and rear length of the headlight 1 can also be shortened by making shorter the depth of the reflection mirror 4*b*.

From the above, according to Embodiment 3, since it is configured that the focal length of the semi-cylindrical concave lens with inclination 3*b* is made shorter at the front side than at the rear side of the headlight 1, it is possible to refract the light emitted by the LED 2 to the rear side of the headlight 1, to thereby reduce the leaking light from the reflection mirror 4*b*. Thus, a headlight 1 with a preferred light distribution can be achieved. Alternatively, since the depth of the reflection mirror 4*b* can be made shorter (that is, a shallow reflection mirror 4*b* is used), it is possible to achieve a compact headlight 1 by shortening the front and rear length of the headlight 1.

Embodiment 4

Figure 17:
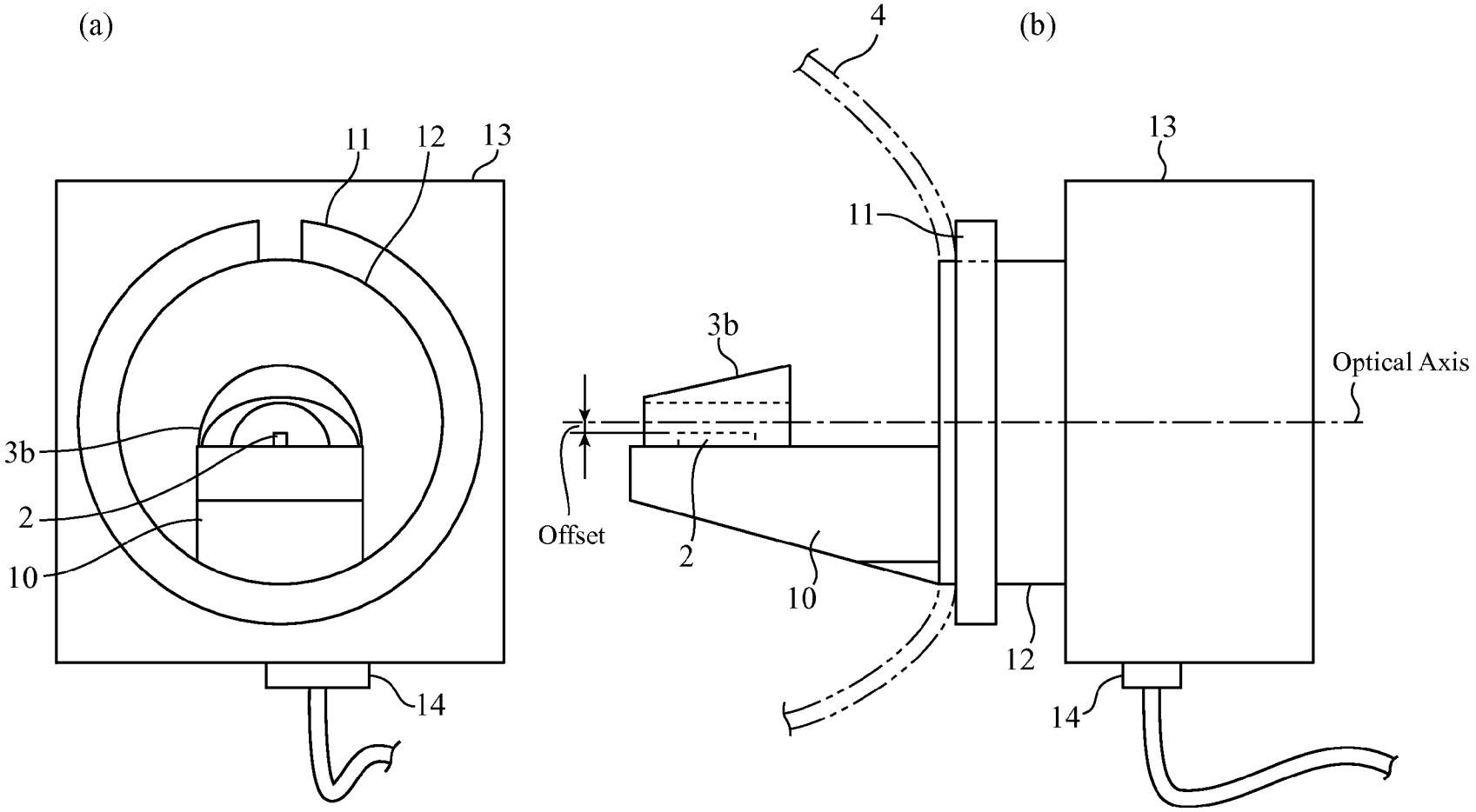
FIG. 17 shows a configuration of a light source for headlight according to Embodiment 4 of the invention.

FIG. 17(*a*) is a front view showing a configuration of a light source for headlight according to Embodiment 4, and FIG. 17(*b*) is a side view thereof. In addition to the LED 2 and the semi-cylindrical concave lens with inclination 3*b*, the light source for headlight includes: a heat transfer member 10 on which the LED 2 and the semi-cylindrical concave lens with inclination 3*b* are placed; a fixing part 12 provided with a fixing flange 11 for the reflection mirror 4 of the headlight 1; a lighting circuit 13 for lighting the LED 2; and a connection connector 14 for connecting the lighting circuit 13 to the vehicle side. In FIG. 17, illustrations of the casing 6 and the front lens 7 of the headlight 1 are omitted.

The heat transfer member 10 transfers heat generated by the LED 2 to the reflection mirror 4 through the fixing flange 11, to thereby dissipate the heat from the reflection mirror 4. Or, when a heat dissipation member is provided on the casing 6 that accommodates the light source for headlight (shown in FIG. 1), the heat generated by the LED 2 is transferred to the heat dissipation member through the heat transfer member 10.

The fixing part 12 is the one for fixing the light source for headlight to the reflection mirror 4 of the headlight 1, and has the fixing flange 11 formed to be latched to the back of the reflection mirror 4. The fixing flange 11 and the reflection mirror 4 are fixed together by a detachably attaching method with a spring, screw-fastening, or the like.

The positioning of the light source for headlight inside the headlight 1 is made through latching of the fixing flange 11 and the reflection mirror 4; thus, when the LED 2 is placed at a predetermined position on the heat transfer member 10 with the fixing flange 11 as a reference, it is possible to set the virtual image of the LED 2 at the position of the optical axis or the focal point of the headlight 1. However, the light emitting surface of the LED 2, not limited to the example in FIG. 17, may be set at the position of the optical axis or the focal point of the headlight 1.

The shape of the fixing part 12 is provided with substantially the same shape as that of a part (base) for fixing an incandescent lamp based on red heat emission of a tungsten filament and a discharge lamp based on arc discharge that are conventional light sources. Note that the incandescent lamp is an in-vehicle halogen lamp represented as a model H3, H4 or the like, for example, and the discharge lamp is an in-vehicle HID lamp represented as a model D1S, D3S or the like, for example.

When the shape of the fixing part 12 is provided with the same shape as that of the base of the conventional light source, a compatibility is established between the light source for headlight using the LED 2 and the conventional light source, so that the light source for headlight shown in FIG. 17 can be used in place of the conventional light source, in the headlight 1 designed for the conventional light source.

The lighting circuit 13 has a DC/DC converter, a control circuit and the like, and steps up or steps down the power source voltage supplied from an in-vehicle battery through the connection connector 14 to a voltage corresponding to the LED 2, and supplies a given current required for the LED 2.

Figure 18:
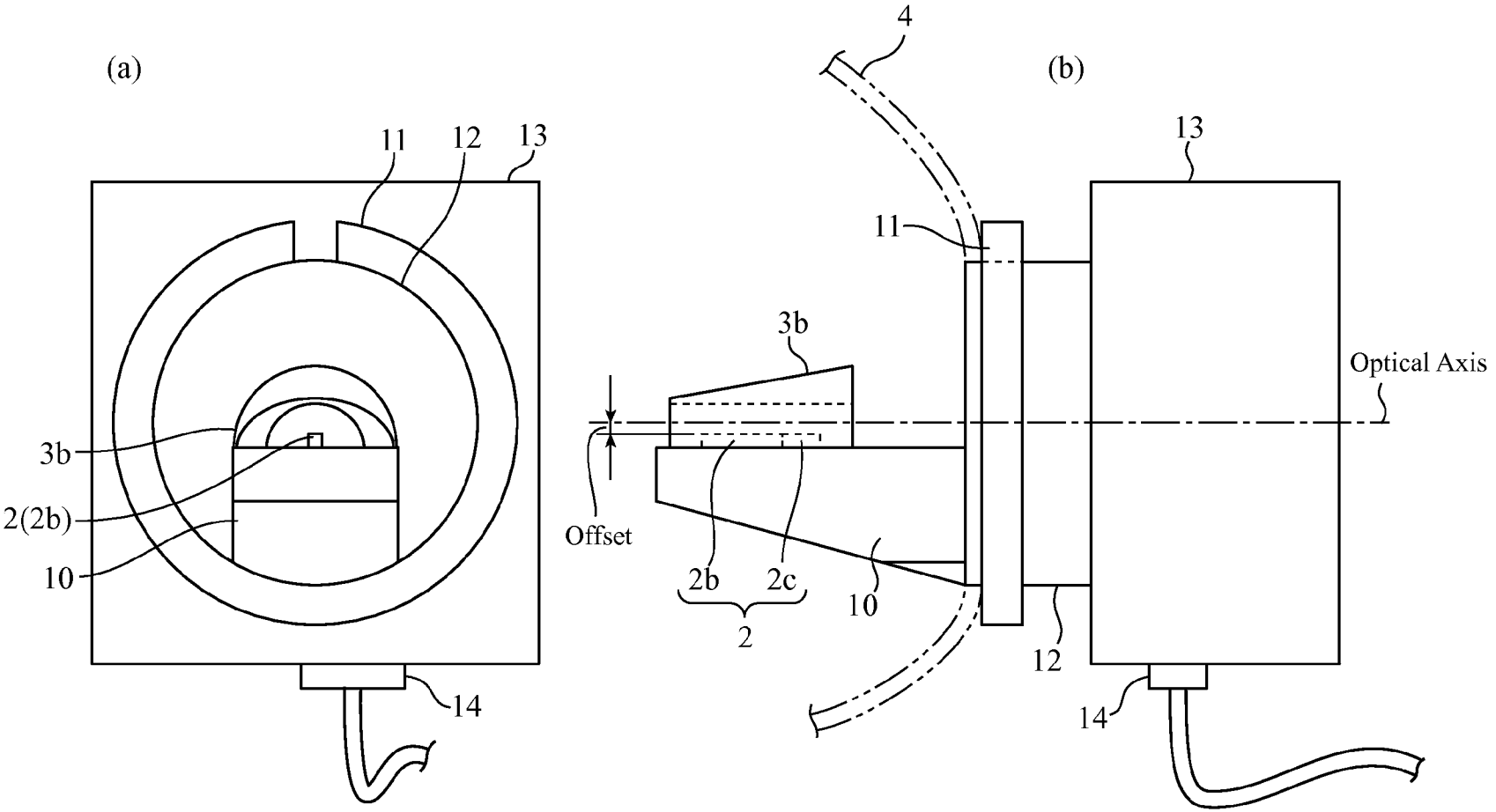
FIG. 18 shows a modified example of the light source for headlight according to Embodiment 4.

In FIG. 17, the light source for headlight capable of forming a light distribution for a passing light is shown; however, as shown in FIG. 18, it is also possible to configure a light source for headlight capable of forming a light distribution for a driving light.

FIG. 18(*a*) is a front view showing a modified example of a light source for headlight according to Embodiment 4, and FIG. 18(*b*) is a side view thereof. As described in FIG. 12 of Embodiment 1 described above, a light distribution for a passing light is formed by lighting the LED 2*b* placed at the front side of the focal point of the reflection mirror 4, and a light distribution for a driving light is formed by lighting the LED 2*c* placed at the rear side of the focal point of the reflection mirror 4 simultaneously with the LED 2*b* at the front side.

From the above, according to Embodiment 4, it is configured that the light source for headlight includes the heat transfer member 10 that transfers the heat generated by the LED 2 to a structure such as the reflection mirror 4. For this reason, when the heat transfer member 10 dissipates the heat generated by the LED 2, an excessively high temperature of the LED 2 can be avoided. Accordingly, degradation of the LED 2 can be prevented, and its life-span is not shortened, so that a highly reliable light source can be achieved.

Further, according to Embodiment 4, it is configured that the light source for headlight is provided integrally with the lighting circuit 13 for lighting the LED 2. For this reason, a connection wiring for connecting the LED 2 and the lighting circuit 13 can be omitted, and thus an accident relating to the wiring can be eliminated, so that a highly reliable light source can be achieved. In addition, since the wiring becomes unnecessary, it is easy to handle. Furthermore, since the wiring becomes unnecessary, it is possible to achieve a compact light source, so that the headlight 1 can be downsized.

Further, according to Embodiment 4, since it is configured that the light source for headlight is provided with the fixing part 12 that is arbitrarily attachable/detachable to the reflection mirror 4, the light source for headlight is easily replaceable, so that the maintenance of the light source becomes easier. Accordingly, it is possible to configure a simple and preferred headlight 1.

Further, according to Embodiment 4, the fixing part 12 is configured to have substantially the same shape as that of the fixing part (base) of the incandescent lamp or discharge lamp. For this reason, a compatibility is established with the conventional light sources such as halogen lamps and HID lamps, so that the corresponding light source for headlight can be used in place of the conventional light source. Accordingly, it is possible to easily use an LED light source with long life and low power consumption such that maintenance for a vehicle is facilitated, and that maintenance cost and fuel cost therefor can be improved.

Embodiment 5

In Embodiment 5, modified examples of the headlights 1 according to Embodiments 1 to 4 described above will be described.

Figure 19:
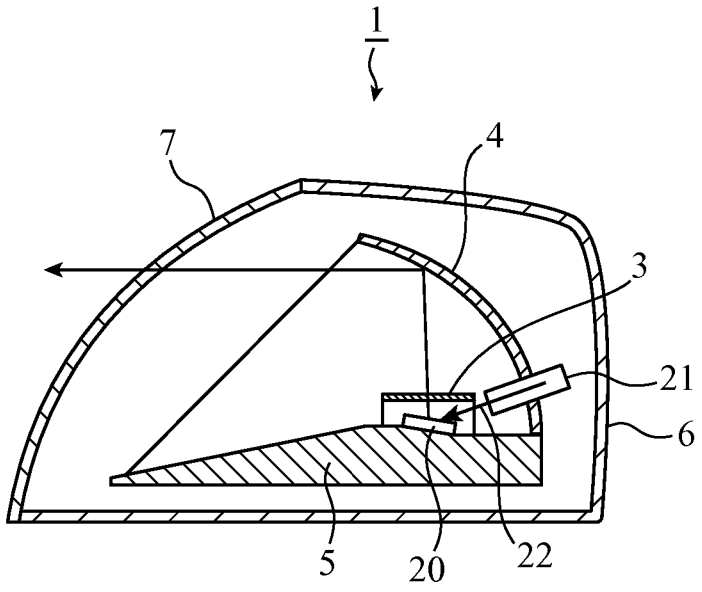
FIG. 19 is a cross-sectional view showing a configuration of a headlight according to Embodiment 5 of the invention.

FIG. 19 is a cross-sectional view showing a configuration of a headlight 1 according to Embodiment 5. Note that in FIG. 19, the same reference numerals are given for the same or equivalent parts as/to those of FIG. 1, and descriptions therefor will be omitted here. In Embodiments 1 to 4 described above, the light sources for headlight are configured using the LED 2 which is a typical light emitting element; however, other than the LED 2, for example, a light emitting element may also be used to emit visible light from a surface of a fluorescent body 20 when it is irradiated with laser light 22 including visible light or ultraviolet light from a laser oscillator 21 as shown in FIG. 19, or irradiated with electromagnetic waves, electrons or the like from another excitation apparatus. Instead, a planar light emitting element like an inorganic or organic EL (Electroluminescence) may also be used. Namely, so long as there is provided with any light emitting element that emits light from a substantial plane having a shape elongated in the optical axis direction of the headlight 1, a light emitting element based on various kinds of light emitting mechanisms can be used without being restricted to the above LED.

Further, the shape of the substantially planar light emitting surface is not necessarily limited to the above substantially rectangular shape, it may be a shape such as a trapezoidal or elliptical shape, other than the rectangular shape, so far as it is elongated in the optical axis direction of the headlight 1.

As described above, when a variety of light emitting elements are employed instead of the LED 2, similar effects to those of Embodiments 1 to 4 described above are accomplished, so that the headlight 1 can be configured with an appropriate light distribution.

Further, in Embodiments 1 to 4 described above, the headlight 1 of the parabolic reflection mirror type is configured by combining the paraboloidal reflection mirror 4 covering the upper side of the LED 2 with the light source for headlight including the LED 2 and the semi-cylindrical concave lens 3; however, an optical member other than these may be combined therewith.

Figure 20:
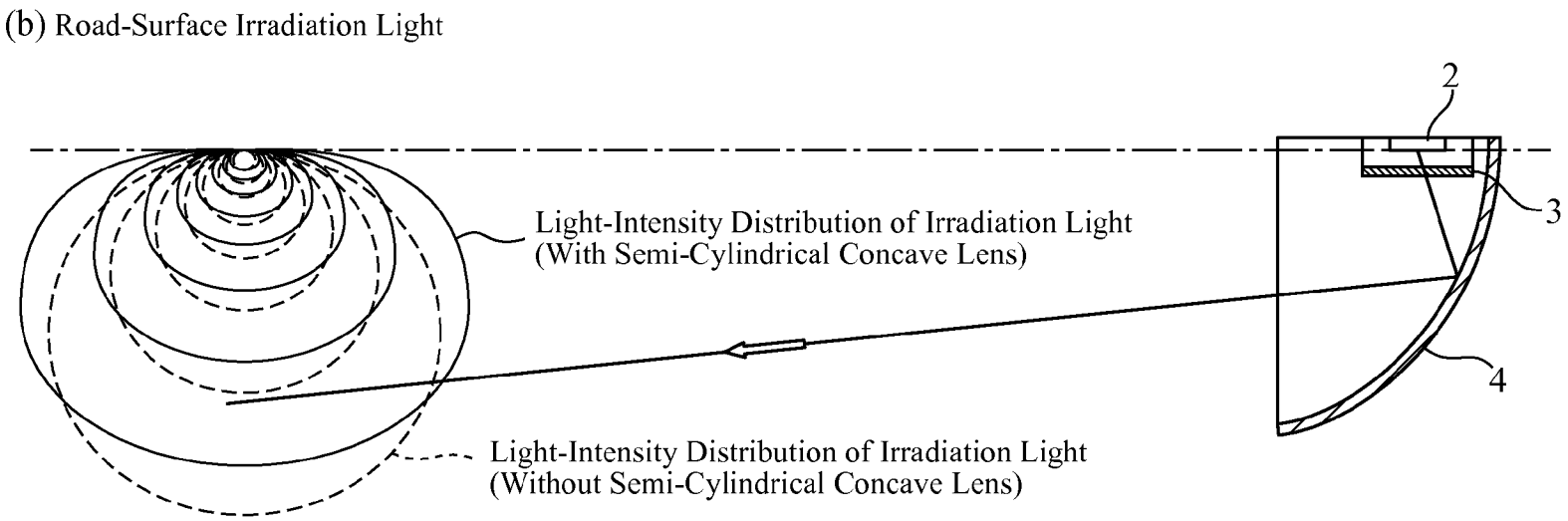
FIG. 20 shows an internal structure of a headlight of a parabolic reflection mirror reflection type according to Embodiment 5.

For example, FIG. 20(*a*) is a cross-sectional view of an internal structure of a headlight 1 of the parabolic reflection mirror type, and FIG. 20(*b*) is a diagram representing road-surface irradiation light. In a configuration example of FIG. 20, the light emitting surface of the LED 2 is placed downward, and the lower side of the LED 2 is covered with the semi-cylindrical concave lens 3 and the parabolic mirror 4.

Figure 21:
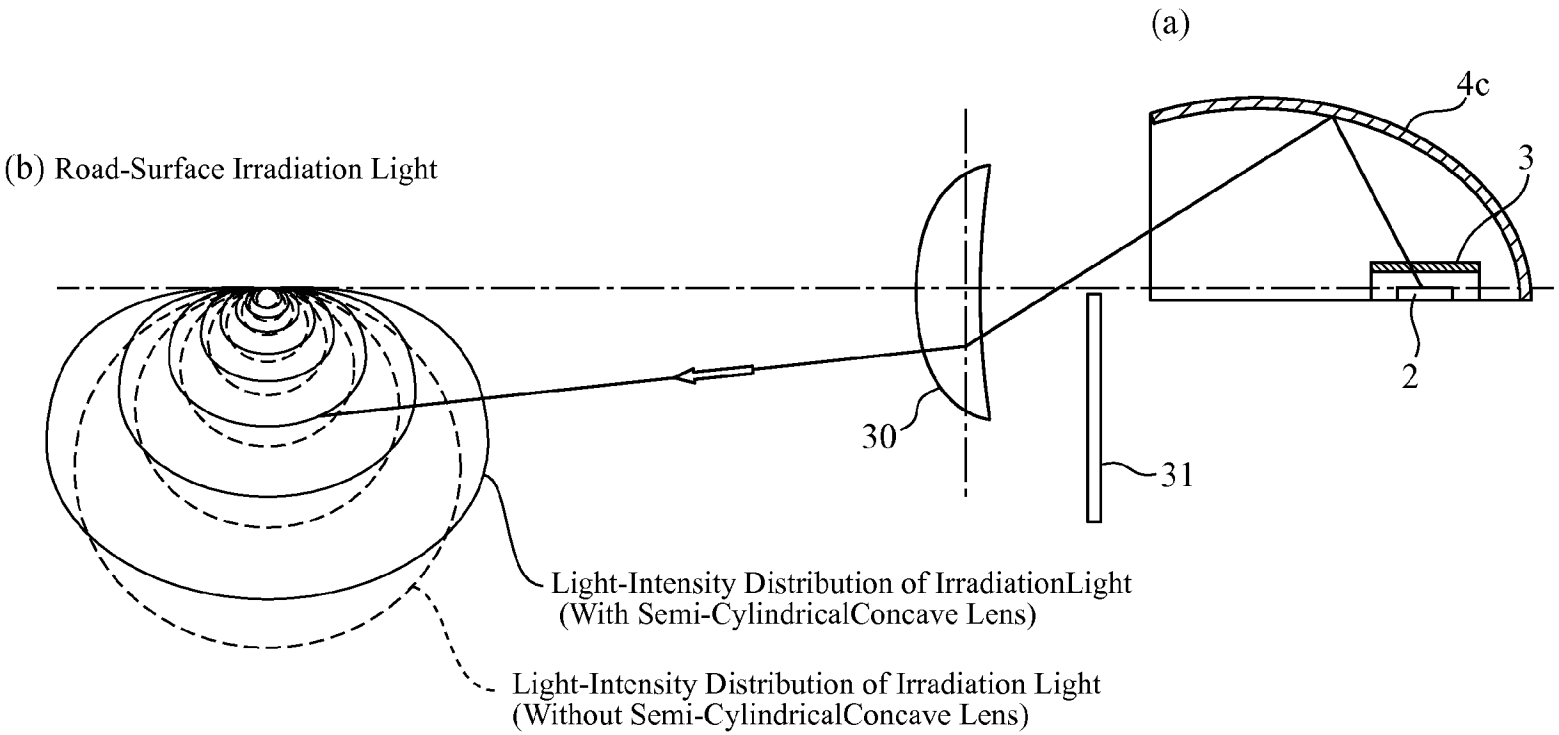
FIG. 21 shows an internal structure of a headlight of a projector type according to Embodiment 5.

Further, for example, FIG. 21(*a*) is a cross-sectional view showing an internal structure of a headlight 1 of a projector type, and FIG. 21(*b*) is a diagram representing road-surface irradiation light. In a configuration example of FIG. 21, the light emitting surface of the LED 2 is placed upward, the upper side of the LED 2 is covered with the semi-cylindrical concave lens 3 and an ellipsoidal mirror 4*c*, and reflected light is refracted by a convex lens 30 for projection and irradiated ahead of the vehicle. Note that in the configuration of FIG. 21(*a*), a light-distribution adjusting shade 31 for forming the cut-off line is used.

Note that FIG. 2, FIG. 20 and FIG. 21 each show a basic configuration of the headlight; in order to achieve a more preferred light distribution, the optical members including the reflection mirrors 4 to 4*c* may be modified from the above basic configuration.

As described above, the aforementioned light source for headlight can be used for the headlight 1 that includes various types of optical members such as the parabolic reflection mirror type or projector type that are constituted by the optical members for the conventional light sources that are compatible with the conventional light sources such as incandescent lamps and discharge lamps; thus, the optical members and design techniques for the conventional light sources can be diverted thereto, so that the headlight 1 can be designed easily.

Other than the above, in the present invention, it is possible to freely combine the embodiments, modify any components of the embodiments, or omit any components in the embodiments within the scope of the invention.

INDUSTRIAL APPLICABILITY

As described above, since the light source for headlight according to the invention can irradiate bright light in the right and left directions ahead of the vehicle like the conventional light sources such as incandescent lamps and discharge lamps even while using the light emitting element that emits the light from the planar surface, it is suitable for the headlight that is constituted by the optical members for the conventional light sources.

DESCRIPTION OF REFERENCE NUMERALS AND SIGNS

1: headlight, 2, 2*b*, 2*c*: LED, 2*a*: virtual image of LED 2, 2-1 to 2-4: semiconductor chip, 3: semi-cylindrical concave lens, 3*a*: deformed semi-cylindrical concave lens, 3*b*: semi-cylindrical concave lens with inclination, 4 to 4*c*: reflection mirror, 5: auxiliary reflection mirror, 6: casing, 7: front lens, 8: monochromatic-light reflection mirror, 9: monochromatic-light shading member, 10: heat transfer member, 11: fixing flange, 12: fixing part, 13: lighting circuit, 14: connection connector, 20: fluorescent body, 21: laser oscillator, 22: laser light, 30: convex lens, 31: shade.

The invention claimed is:

1. A light source for headlight to be used for a headlight provided with an optical member that irradiates light to the front side of a vehicle, comprising:

a light emitting element having a light emitting surface that is substantially planar and elongated in an optical axis direction of the headlight; and a semi-cylindrical concave lens having a focal axis in substantially the same direction as the optical axis direction of the headlight, wherein the semi-cylindrical concave lens is placed between the optical member and the light emitting element.

2. The light source for headlight according to claim 1, wherein the light emitting surface of the light emitting element is placed with shifted on the opposite side of a reflection mirror that is the optical member with respect to the optical axis of the headlight.

3. The light source for headlight according to claim 1, wherein a light-emitting direction of the light emitting element is placed with rotated by a predetermined angle about the optical axis direction of the headlight as a rotation axis.

4. The light source for headlight according to claim 1, wherein a focal length of the semi-cylindrical concave lens is shorter at the front side of the headlight than at the rear side thereof.

5. The light source for headlight according to claim 1, further comprising integrally a lighting circuit that lights the light emitting element.

6. The light source for headlight according to claim 1, wherein the light emitting element includes a plurality of light emitting elements that can be lighted arbitrarily.

7. The light source for headlight according to claim 6, wherein the light emitting element includes a first light-emitting element placed at the front side of a focal point of the reflection mirror that is the optical member, and a second light-emitting element placed at the rear side of the focal point.

8. The light source for headlight according to claim 1, wherein the semi-cylindrical concave lens is formed of a glass or a resin.

9. The light source for headlight according to claim 1, wherein the light emitting element is an LED.

10. The light source for headlight according to claim 1, further comprising a fixing part that can be attached or detached arbitrarily to the optical member.

11. The light source for headlight according to claim 10, wherein the fixing part has substantially the same shape as a fixing part of an in-vehicle incandescent lamp or discharge lamp.

12. A headlight provided with an optical element that irradiates light emitted from a light source for headlight to the front of a vehicle, wherein the light source for headlight comprises:

a light emitting element having a light emitting surface that is substantially planar and elongated in an optical axis direction of the headlight; and a semi-cylindrical concave lens having a focal axis in substantially the same direction as the optical axis direction of the headlight, wherein the semi-cylindrical concave lens is placed between the optical member and the light emitting element.

13. The headlight according to claim 12, further comprising a mechanism that, among the light emitted from the light source for headlight, shields light emitted toward the dark side in a bright and dark boundary at the front side to which the headlight irradiates, or reflects the light in a direction so as not to be irradiated to the front side of the headlight.

* * * * *